US008171821B2

(12) United States Patent
Krozek

(10) Patent No.: US 8,171,821 B2
(45) Date of Patent: May 8, 2012

(54) CORNER CAM ASSEMBLY

(75) Inventor: Jeffrey C. Krozek, Harrison Township, MI (US)

(73) Assignee: Helical Cam, LLC, Algonac, MI (US)

( * ) Notice: Subject to any disclaimer, the term of this patent is extended or adjusted under 35 U.S.C. 154(b) by 1430 days.

(21) Appl. No.: 11/710,165

(22) Filed: Feb. 22, 2007

(65) Prior Publication Data

US 2008/0078344 A1 Apr. 3, 2008

Related U.S. Application Data

(60) Provisional application No. 60/847,887, filed on Sep. 28, 2006.

(51) Int. Cl.
*F16H 53/00* (2006.01)
*B21D 11/00* (2006.01)
*B21J 9/18* (2006.01)

(52) U.S. Cl. ..... 74/567; 72/313; 72/315; 72/452.9

(58) Field of Classification Search ..... 74/337.5, 74/53–61, 122–125, 567, 569; 72/313, 452.9, 72/452.4, 452.6, 452.7, 315; 269/902, 66, 269/138; 29/888.1
See application file for complete search history.

(56) References Cited

U.S. PATENT DOCUMENTS

| | | | | |
|---|---|---|---|---|
| 1,850,544 | A | | 3/1932 | Gray |
| 1,977,828 | A | | 10/1934 | Laib et al. |
| 2,176,895 | A | | 10/1939 | Engemann |
| 2,272,740 | A | | 2/1942 | Fader, Jr. |
| 2,633,112 | A | | 3/1953 | Engemann |
| 3,391,239 | A | | 7/1968 | Inouye |
| 3,955,241 | A | | 5/1976 | Little |
| 4,030,161 | A | | 6/1977 | Loikitz |
| 4,181,002 | A | | 1/1980 | Eckold et al. |
| 4,535,619 | A | | 8/1985 | Gargrave |
| 5,101,705 | A | | 4/1992 | Matsuoka |
| 5,163,662 | A | * | 11/1992 | Bernstein ..... 269/138 |
| 5,231,907 | A | | 8/1993 | Matsuoka |
| 5,347,838 | A | | 9/1994 | Matsuoka |
| 5,746,082 | A | | 5/1998 | Matsuoka |

(Continued)

FOREIGN PATENT DOCUMENTS

WO WO0179662 A1 10/2001

OTHER PUBLICATIONS

International Search Report for PCT/US07/08239, Mar. 27, 2008, 2 pgs.

*Primary Examiner* — Richard W Ridley
*Assistant Examiner* — Daniel Yabut
(74) *Attorney, Agent, or Firm* — Reising Ethington P.C.; Michael C. Adams

(57) ABSTRACT

A corner cam assembly for use with a forming die and including a generally cylindrical inner cam component, an outer cam component, a base, and a retainer unit. Contoured contact surfaces on the inner and outer cam components enable the components to slide past one another during transitions between retracted and extended positions. Some features of the corner cam assembly include helical contact surfaces, guide features that control movement of the cam components, removable work steels, standardized cam components, and being able to form negative and other tight angles, multiple corners and edges, to name but a few.

17 Claims, 8 Drawing Sheets

U.S. PATENT DOCUMENTS

| | | | | |
|---|---|---|---|---|
| 5,784,916 | A | 7/1998 | Matsuoka | |
| 5,884,521 | A * | 3/1999 | Fidziukiewicz | 72/452.9 |
| 5,931,074 | A | 8/1999 | Matsuoka | |
| 6,016,680 | A | 1/2000 | Matsuoka | |
| 6,038,908 | A | 3/2000 | Kinoshita | |
| 6,167,741 | B1 | 1/2001 | Matsuoka | |
| 6,196,040 | B1 | 3/2001 | Matsuoka | |
| 6,220,137 | B1 | 4/2001 | Matsuoka | |
| 6,230,536 | B1 * | 5/2001 | Matsuoka | 72/313 |
| 6,336,399 | B1 | 1/2002 | Matsuoka | |
| 6,519,995 | B2 | 2/2003 | Matsuoka | |
| 6,523,386 | B2 | 2/2003 | Matsuoka | |
| 6,526,797 | B2 | 3/2003 | Matsuoka | |
| 6,539,766 | B2 * | 4/2003 | Matsuoka | 72/313 |
| 6,619,095 | B2 | 9/2003 | Matsuoka | |
| 7,392,775 | B2 | 7/2008 | Krozek | |
| 7,523,634 | B2 | 4/2009 | Krozek | |
| 2005/0155443 | A1 | 7/2005 | Krozek | |
| 2006/0042348 | A1 | 3/2006 | Krozek | |

* cited by examiner

CORNER CAM ASSEMBLY

REFERENCE TO RELATED APPLICATIONS

This application claims the benefit of U.S. Provisional Application No. 60/847,887 filed Sep. 28, 2006, the entire contents of which are incorporated herein by reference.

TECHNICAL FIELD

The present invention relates generally to a cam assembly, and more particularly, to a corner cam assembly for use with a forming die, such as those used in the automotive industry to form corners and other difficult angles in metal work pieces.

BACKGROUND OF THE INVENTION

Various types of forming dies have been developed for forming a wide variety of metal part configurations, particularly in the automotive industry. One example of such a forming die utilizes a rotary cam in order to form a negative-angle on piece of sheet metal. A "negative angle" or "back draft" is broadly defined as any angle formed in a metal work piece where at least a portion of the formed section extends more inwardly than a straight downward stroke line (beyond 90°), and is appreciated by those skilled in the art.

It is known in the art to provide a forming die with a lower die half, an upper die half, an upper die pad, a work cam and a rotary cam for forming a piece of sheet metal. The work piece is placed on a post of the lower die half and the rotary cam, then the upper die half is lowered causing the upper die pad to clamp the piece of sheet metal to the lower die post and rotary cam, prior to forming. Next, a work cam (which can be mounted to either the upper or lower die halves) is driven such that the sheet metal work piece is formed to the desired shape. The upper die half continues being lowered until a desired shut height between the upper and lower die halves is achieved. Once the final formed shape is complete the upper die half is raised and the two die halves separate so that the formed sheet metal can be removed.

SUMMARY OF THE INVENTION

There is provided a cam assembly for use in forming a work piece, comprising an inner cam component, an outer cam component, and an axial shaft. The inner cam component is generally cylindrical and has a first contact surface, a first metal forming portion, and an axial bore. The outer cam component is generally located radially outward of the inner cam component and has a second contact surface and a second metal forming portion. The axial shaft extends in the axial bore of the inner cam component. Application of a force on the inner cam component causes a relative movement between the first and second contact surfaces such that the inner and outer cam components are driven into an extended position for forming a work piece.

According to another aspect, there is provided a cam assembly for use in forming a work piece, comprising an inner cam component, an outer cam component, and a base. The inner cam component has a first metal forming portion, a first contact surface, and a recessed section. The outer cam component has a second metal forming portion and a second contact surface. Application of a force on the inner cam component causes the inner cam component to be squeezed against the outer cam component so that the inner cam component is driven into an extended position according to relative movement between the first and second contact surfaces.

BRIEF DESCRIPTION OF THE DRAWINGS

These and other objects, features and advantages will be apparent from the following detailed description of the preferred embodiments and best mode, the appended claims and the accompanying drawings, in which:

FIG. 6 shows the assembly in a retracted or unloading position and FIG. 7 shows the assembly in an extended or forming position.

DETAILED DESCRIPTION OF THE PREFERRED EMBODIMENTS

Figure 1:
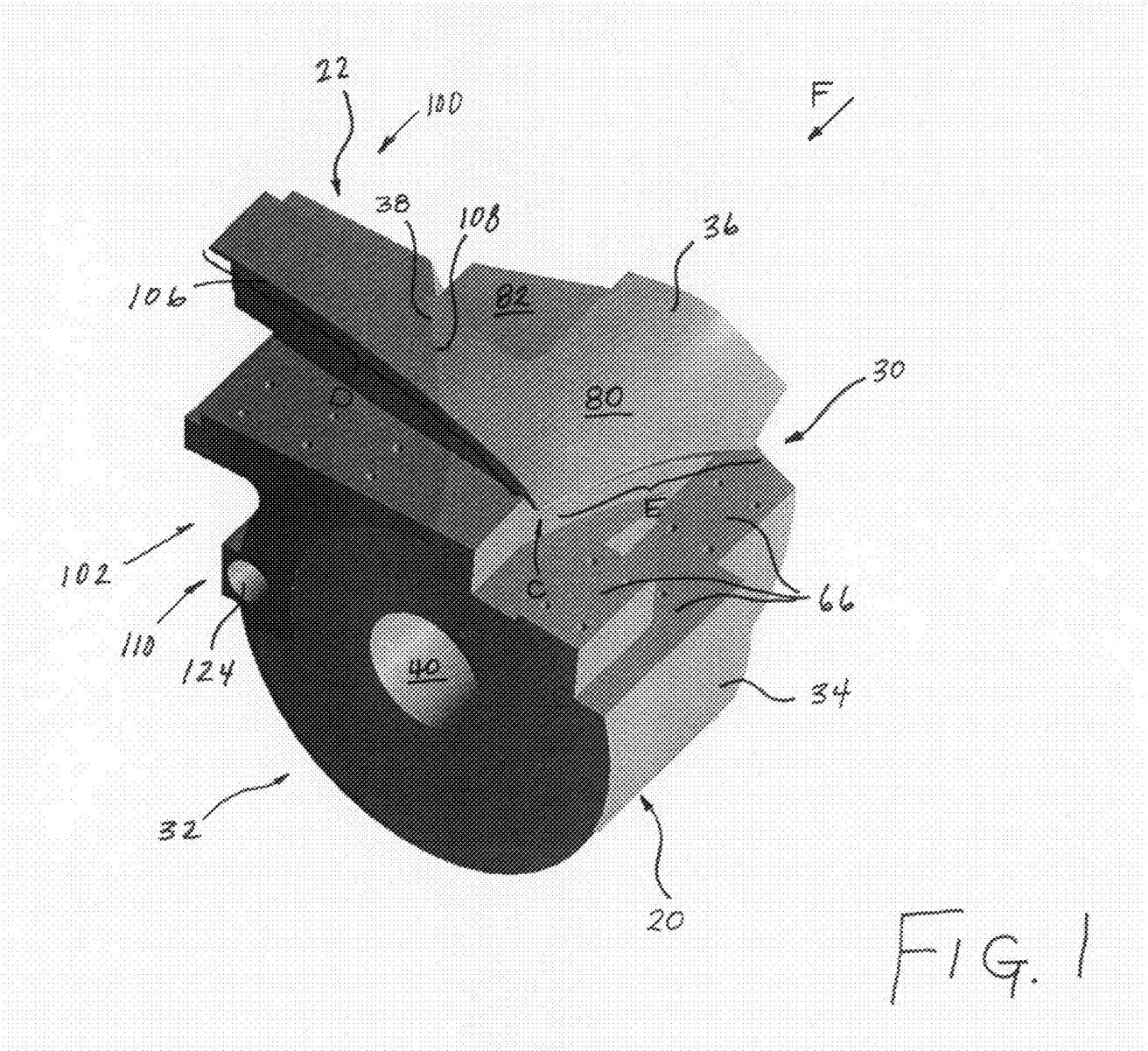
FIG. 1 is an isometric view of an embodiment of the inner and outer cam components of a corner cam assembly, where the cam components are shown in a mated position.

The corner cam assembly described herein can be used with one of a number of different types of forming dies, including those designed to form corners, negative angles, back drafts, creases, flanges, hems, beads, darts, pockets, embosses, and other difficult or complex work piece configurations. Oftentimes, these configurations are found on vehicle body side panels, fenders, quarter panels, hoods, roofs, deck lids, as well as other class A surfaces. The present corner cam assembly can be used in conjunction with a forming die that forms multiple edges and corners simultaneously such that an entire formable periphery of a work piece can be done in a single forming operation. An example of a suitable forming die with a filler cam assembly is disclosed in U.S. application Ser. No. 11/209,535, filed Aug. 23, 2005, the entire contents of which are incorporated herein by reference.

Corner cam assembly 10 is particularly well suited for forming the area surrounding tight and otherwise difficult corners of a metal work piece, and generally includes an inner cam component 20, an outer cam component 22, a base 24, and a retainer unit 26. Inner cam component 20 is preferably made of hardened tool steel and is designed to move between extended and retracted positions so that it can adequately fill out a corner during a forming operation, but still retract to a non-interfering position so that the formed work piece can be removed from the tool. According to the embodiment shown here, inner cam component 20 is a generally cylindrical component and includes first and second axial ends 30, 32, a cylindrical side portion 34, a metal forming portion 36, a contact surface 38, and an axial bore 40 for receiving an axial shaft 42.

First axial end 30 is designed to receive a force F and to transmit that force throughout the corner cam assembly so that the assembly can transition from a retracted or unloading position to an extended or forming position. It should be appreciated that force F could be generated by one of any number of different sources, including: an adjacent cam assembly pushing on inner cam component 20, a pneumatic or hydraulic cylinder exerting an urging force against the inner cam component, a compression spring, and a drive mechanism used to cycle the inner cam component between positions, to name but a few possibilities. According to the embodiment shown here, first axial end 30 includes one or more helical surfaces 50, 52 (best seen in FIG. 2) which are designed to slidingly interact with opposing helical surfaces located on an adjacent cam assembly, such as the one shown in FIG. 5. The use of opposing helical surfaces in this manner creates a balanced heeling effect which results in a smooth transition between retracted and extended positions. For a more comprehensive description of a suitable helical surface, please see U.S. application Ser. No. 11/037,419, filed Jan. 18, 2005, the entire contents of which are incorporated herein by reference. It should be noted that in instances where two surfaces are contacting one another during relative movement therebetween, such as with the helical surfaces just described, the surfaces may be provided with a flash-chrome, PTFE, graphic-impregnated plugs, or other types of surface coatings and/or treatments in order to reduce the friction and/or wear between the components.

According to another embodiment that involves an adjacent cam assembly as the source of a force F, a conventional rotary cam lacking helical surfaces can be used to impart an axial force F on first axial end 30. In this arrangement, helical surfaces 50, 52 would probably need to be substituted for non-helical axial end surfaces designed to interact with the axial end surface of the rotary cam. It should be pointed out that the overall force exerted on first axial end 30 does not have to be exclusively axial in nature. For instance, a combined axial/rotational force or just a rotational force could be applied to inner cam component 30 in a manner that results in a corresponding force F. These are, of course, only a couple of the possible scenarios surround force F, so long as a force component is being exerted against inner cam component 20 such that it causes movement of the inner cam.

Second axial end 32 is shown here having a generally flat and annular surface located on an outer end of inner cam component 20. It should, of course, be appreciated that this is only one possible configuration for the second axial end, as numerous other configurations, including those having contours, steps, grooves, channels, etc., are also possible. As will be subsequently described in greater detail, second axial end 32 is designed to engage retainer unit 26, which generally extends across corner cam assembly 10 and limits the axial range of motion of the inner and outer cam components 20, 22.

Figure 4:
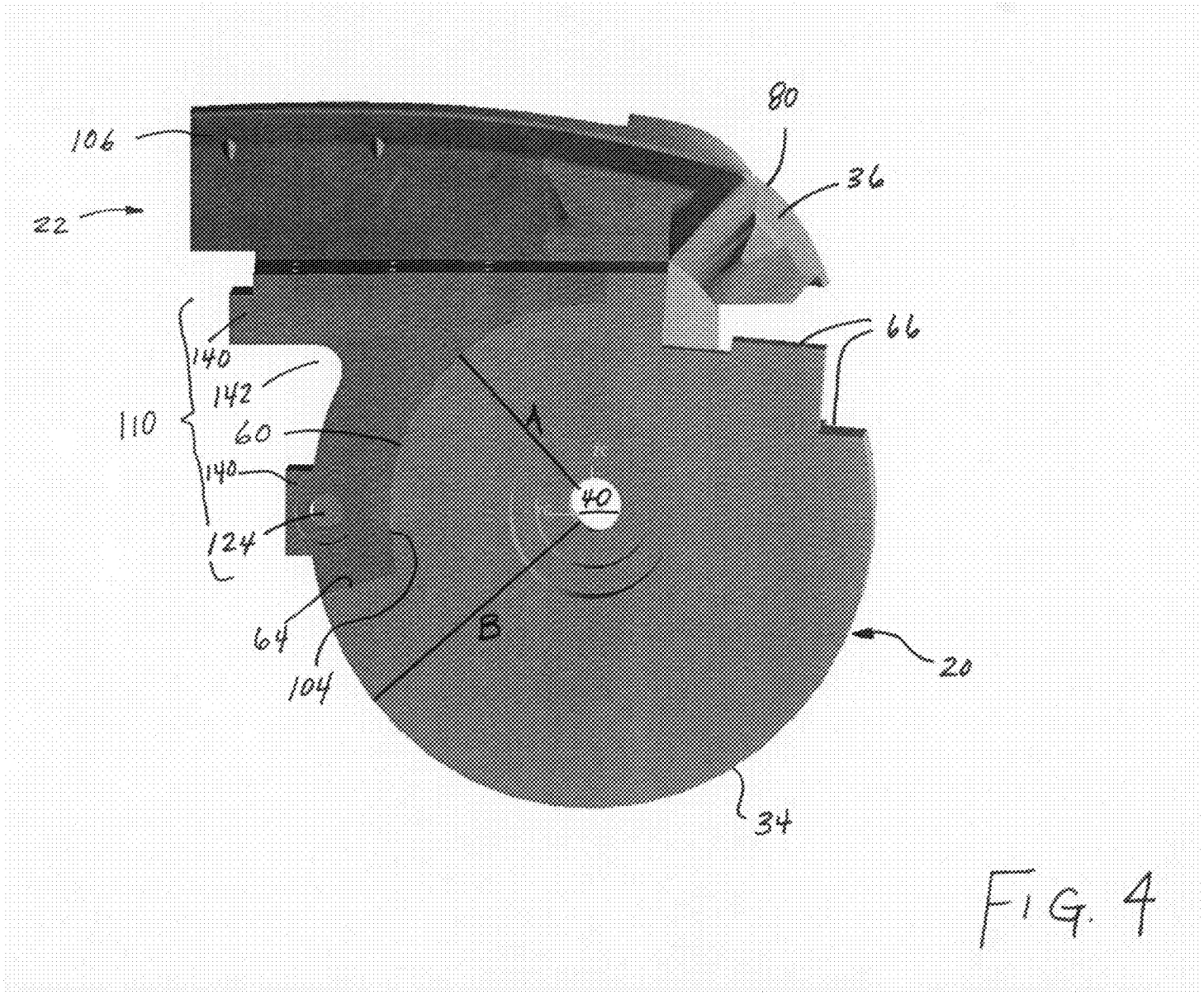
FIG. 4 is an end view of the inner and outer cam components of FIG. 1, shown with the cam components in a mated position.

Cylindrical side portion 34 extends around a portion of inner cam component 20 and includes sections having smooth outer surfaces designed to rotate within a complimentarily-shaped nest or cradle in base 24. Again, the contacting surfaces can be provided with a flash-chrome, PTFE, graphic-impregnated plugs, or other types of friction-reducing surface. Cylindrical side portion 34 further includes a recessed section 58 at least partially defined by an exterior slide surface 60, a mating flange 62, and a ramp section 64, and wear plates 66. Exterior slide surface 60 is preferably a smooth outer cylindrical surface generally defined by a radius A, which is smaller than a radius B which defines portions of cylindrical side portion 34. Recessed section 58 is a somewhat arcuate channel that is formed in an outer surface of the inner cam component in order to receive the outer cam component so that the two can nest tightly together, as demonstrated in FIGS. 1 and 4.

Ramp section 64 is sloped at an angle and terminates at one end in mating flange 62 and, in conjunction with a similarly angled ramp section 68, creates a positive return effect as appreciated by those skilled in the art. The particulars of the ramp section, the degree of its incline, the length of the ramp, etc. are at least partially dictated by the desired paths that the inner and outer cam components are supposed to take, as the outer cam component rides on ramp section 70 during movement between retracted and extended positions. Mating flange 62 is an arcuate flange or lip that limits the axial extent to which outer cam component 22 can travel. Once the outer cam component is fully nested within recessed section 58 such that it contacts mating flange 62 (a mated position shown in FIGS. 1 and 4), the outer cam component is prohibited from traveling any further in that axial direction. Wear plates 66 are simply flat metal pieces that have been attached to stepped sections of cylindrical side portion 34 and provide a sliding surface for an opposing work cam. This protects inner cam assembly 20 from wear and tear that would otherwise be caused by frictional and other forces created during the forming process.

Metal forming portion 36 extends from cylindrical side portion 34 in a generally radial manner so that it can participate in the actual forming of the metal work piece and, according to the embodiment shown here, includes a metal forming surface 80, a rear wall that forms part of helical surface 52, and a side wall that forms part of contact surface 38. In the current embodiment, metal forming portion 36 is an integrally formed part of inner cam component 20, however, the metal forming portion could include one or more replaceable work steels, as explained more thoroughly in U.S. application Ser. No. 11/209,535. In the event that replaceable work steels are used, one or more mounting features like gibs, keeper channels, keyways, bolts, dowels, mounting brackets, etc. should be used in order to ensure their proper attachment. Metal forming surface 80 is contoured according to the desired shape of the metal part being formed so that when the work piece is mounted on the tool, surface 80 can support it from underneath and allow a cooperating work cam to form the part, as is appreciated by skilled artisans. One or more recesses or indentations 82 can be formed in metal forming portion 36 to provide clearance for other components, so long as there is no need to support the work piece at that particular location.

Contact surface 38 assists in enabling inner and outer cam components 20, 22 to smoothly slide against one another during transitions between retracted and extended positions. In accordance with the specific embodiment shown here, contact surface 38 preferably includes a helical contact surface, such as those described in U.S. application Ser. No. 11/037,419; as does an opposing contact surface on outer cam component 22. Although the actual surface area varies with the particular application at hand, contact surface 38 should have enough surface area to adequately distribute the contact pressure existing between the two cam components across surface 38. As before, better distribution of the contact pressure generally results in a more balanced heeling effect between inner and outer cam components 20, 22, which in turn makes for a smoother transition between retracted and extended positions.

Axial bore 40 longitudinally extends along the length of inner cam component 20 so that the axial bore can receive an axial shaft 42, which allows for rotation of the inner cam component about the axial shaft as well as within base 24. Preferably, axial shaft 42 is stationary and generally extends the length of corner cam assembly 10 so that when cam components 20, 22 rotate from a retracted to an extended position, they do so against the force of one or more springs 90 which are preferably located between inner cam component 20 and retainer unit 26. According to an alternative embodiment, the axial shaft could be fortified to an extent where portions of base 24 are omitted. In this example, the axial shaft would be responsible for carrying much of the forces bearing down on the corner cam assembly 10 during forming, and would have to be designed to adequately withstand those forces, which are not insignificant. Of course, other modifications to corner cam assembly 10 would also be likely in order to make removal of portions of base 24 successful.

Outer cam component 22 is generally located radially outward of inner cam component 20 and is designed to slide along exterior slide surface 60 during transitions between retracted and extended positions. Of course, not every single part of outer cam component 22 needs to be outbound of every single part of inner cam component 20, as there could be some extremities of the inner cam component that are located radially outward of the outer cam component. According to the embodiment shown here, outer cam component 22 includes first and second axial ends 100, 102, an interior slide surface 104, a metal forming portion 106, a contact surface 108, and guide features 110.

First axial end 100 contacts inner cam component 20 so that a force F exerted on the inner cam component can be imparted to the outer cam component. In this particular embodiment, first axial end 100 includes a circumferentially extending or arcuate-like mating surface 120 that is designed to contact the complementarily-shaped mating flange 62. In embodiments where it is desirable to provide some separation between the inner and outer cam components, a spring or the like may be inserted in opening 122 so that it protrudes from first axial end 100 and contacts mating flange 62. Alternatively, a spring could be installed in an opening 124 so that it extends out of the second axial end 102 and contacts retainer unit 26. In either instance, decisions regarding the addition of the spring and characteristics of the spring are largely driven by the desired travel paths for the inner and outer cam components. Although second axial end 102 is shown here as having a generally flat or planar face, the actual configuration of the second axial end is generally dictated by the characteristics of retainer unit 26 and/or any other components that the outer cam component may contact when it is driven into an extended position.

As its name suggests, interior slide surface 104 is designed to slide along exterior slide surface 60 so that the outer cam component can move smoothly within recessed section 58. A corner 130 of the outer cam component is configured to nest within a corresponding pocket formed at the interior corner or intersection of ramp section 64 and mating flange 62, thus providing a nice tight fit during mating of the two cam components. The specifics of the interior slide surface, such as the circumferential extent of the surface, the clearance with the exterior slide surface, etc. are generally determined by the particular requirements of the application in which the corner cam assembly is being used.

Metal forming portion 106 is carried by the outer cam component so that when corner cam assembly 10 is driven into an extended or forming position, the metal forming sections 36, 106 will line up and effectively act as a unitary metal forming portion. Because metal forming portion 106 extends down the work piece away from the corner, corner cam assembly 10 is able to not only form the actual corner C itself, but also edges D and E on both sides of the corner for a rather significant linear extent (please refer to FIG. 1). Stated differently, some prior art cam assemblies are only able to form a corner, but not significant edges or peripheries extending away from the corner; the corner cam assembly shown here is able to accomplish this in a robust manner that prevents otherwise fragile metal forming portions from breaking off. As before, although metal forming portion 106 is shown here being integrally formed with outer cam component 22, but it could be substituted with the replaceable work steels previously described.

Contact surface 108 is preferably a contoured surface that is designed to slide against contact surface 38, which was previously described. According to one embodiment, contact surface 108 is a helical surface, complementary in shape to helical surface 38. As previously described, these smooth helical surfaces enable both rotational and axial movement between the two cam components and reduce the chances of the corner cam assembly 10 becoming jammed or hung-up during operation. Again, for more information on potential helical surface designs, please consult U.S. application Ser. No. 11/037,419.

Figure 2:
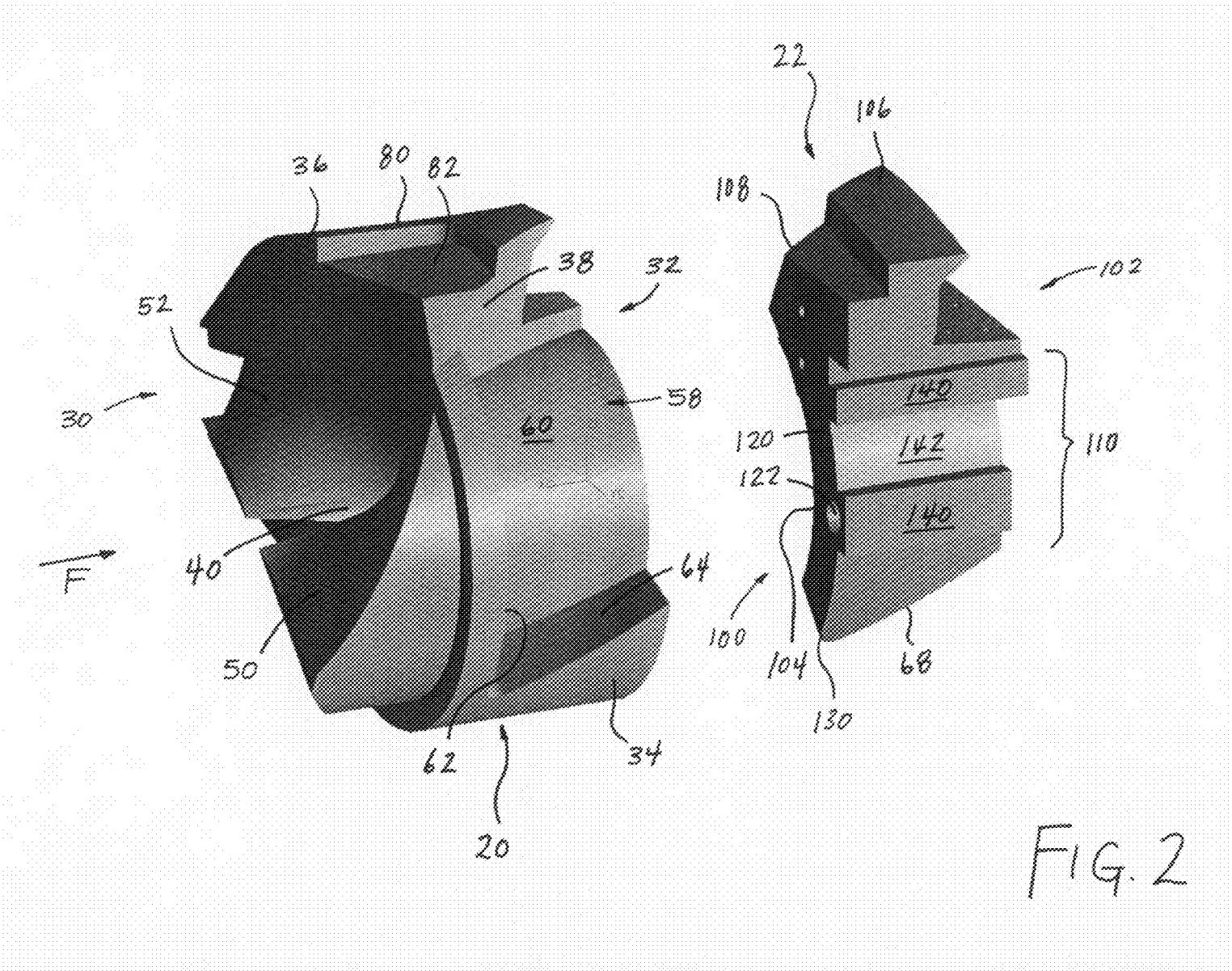
FIGS. 2-3 are isometric views of the inner and outer cam components of FIG. 1, shown from different perspectives and with the cam components in separated positions.
Figure 3:
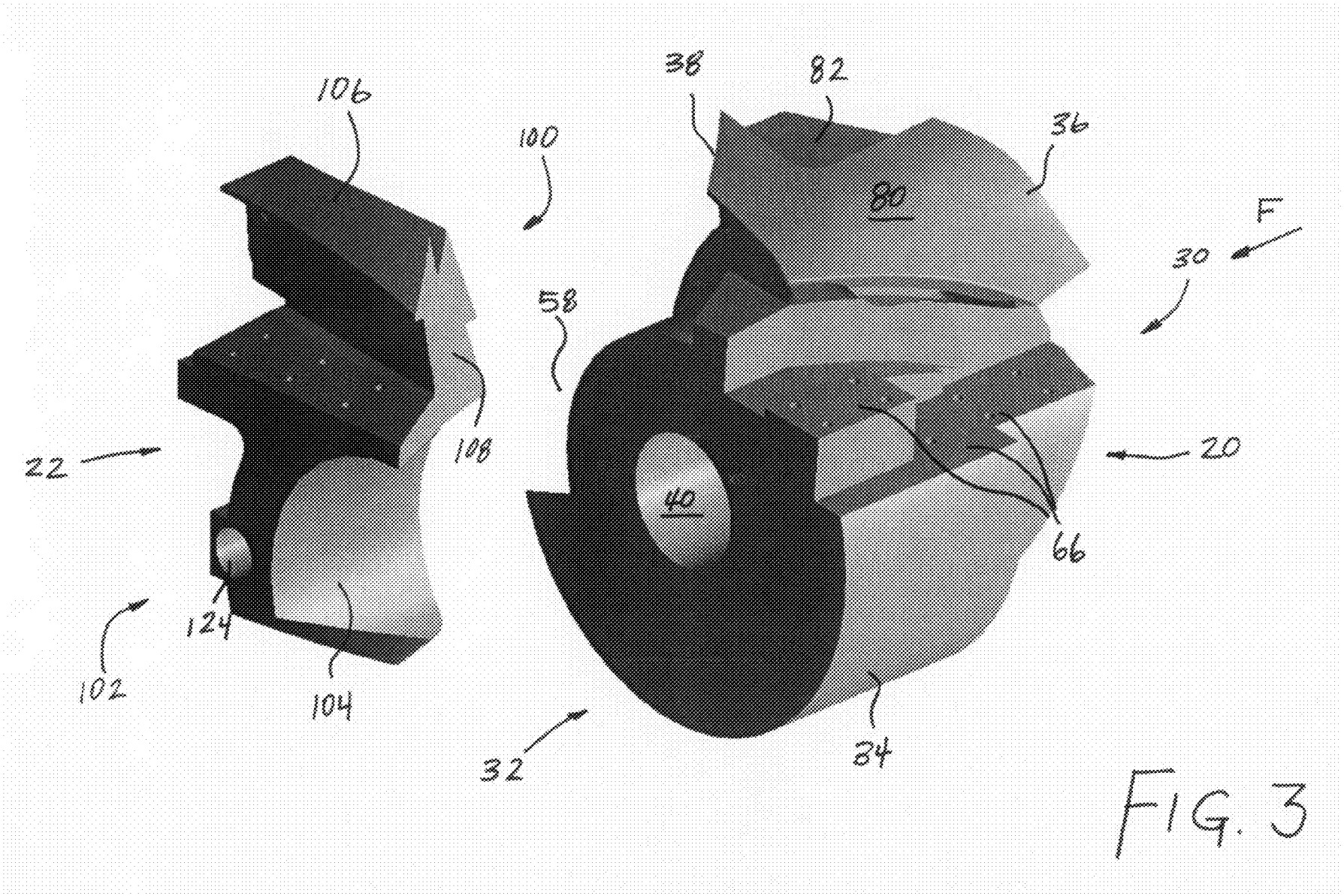

Guide features 110, which are best illustrated in FIG. 2, define a predetermined path that outer cam component 22 follows during transitions between retracted and extended positions, and vice-versa. According to this particular embodiment, guide features 110 are linearly-aligned such that they guide outer cam component 22 in a generally axial direction and include a pair of gibs 140 and a keeper channel 142 that interact with corresponding guide features located in a cradle of base 24. This gibbed construction is only an exemplary form of the guide features, as other possibilities include barrel slots, pins, bearings, cam followers, as well as other suitable devices known in the art for controlling the path or movement of cams. By dictating a predetermined path to the outer cam component, corner cam assembly 10 is able to control the movement of the outer cam component during operation and, in this particular embodiment, its movement is limited to the axial direction.

It should, of course, be appreciated that guide features 110 could extend in one of a number of different orientations other than the axial orientation shown here. For instance, the guide features could be aligned along a linear path that is angled with respect to the axial shaft 42, it could be aligned along a non-linear path that follows a somewhat spiral extent, or it could be aligned along a complex path that includes both linear and non-linear components, to name but a few examples. In any event, guide features 110 dictate a predetermined path for outer cam component 22, which has an effect on the movement or path of inner cam component 20, as will be explained. It is also possible to omit guide features 110 from the outer cam component and to add them to inner cam component 20 so that the inner cam component follows a predetermined path. In that embodiment, the outer cam component could be free to float within certain areas of the corner cam assembly. Furthermore, there are instances when it would be appropriate to include guide features on both the inner and outer cam components and to control their movements along predetermined paths accordingly.

Figure 5:
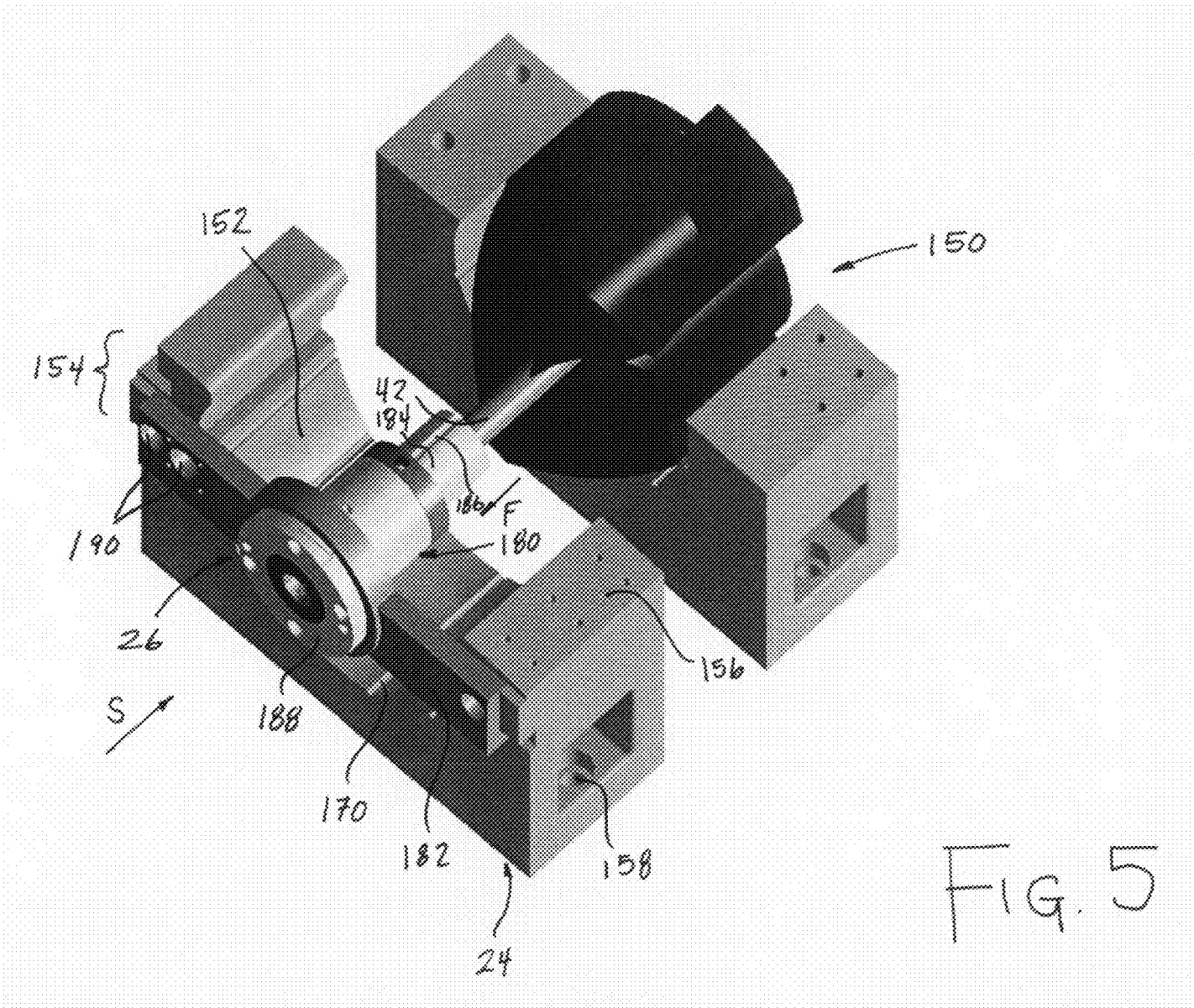
FIG. 5 is an isometric view of an embodiment of a base and retainer unit of a corner cam assembly, where an adjacent cam assembly is shown nested within an adjacent base and inner and outer cam components of the corner cam assembly have been removed for purposes of illustration.

With reference now to FIG. 5, there is shown examples of a base 24 and a retainer unit 26 that are used to maintain inner and outer cam components 20, 22 in their proper position during operation. To clarify, FIG. 5 also shows an adjacent cam assembly 150 that is simply an example of a cam assembly that can be used to exert a force F on the inner cam component, as previously described (inner and outer cam components 20, 22 are not shown in FIG. 5). Again, this is only one type of device that can be used to exert such a force, as others are possible and known in the art. Base 24 provides a nest for operably receiving inner cam component 20 and for securing the corner cam assembly 10 to a lower die half or other part of a forming die. The base 24 is preferably a cast and machined foundation made from durable flame hardened steel and generally includes a nest 152, guide features 154, wear plate 156, mounting feature 158 for bolting or otherwise connecting base 24 to the forming die, and other base-related features such as cross keys, location pins, threaded bolts, etc.

Nest 152 preferably has a generally semi-circular cross-section for rotatably accommodating inner cam component 20 and can be coated with an appropriate surface treatment such as flash chrome, PTFE, graphic-impregnated plugs, or other friction-reducing and/or wear-resistant surface treatments, as previously discussed. Nest 152 preferably extends the entire length of base 24 so that it is open on both ends, and can include relief grooves 170. In some embodiments, relief grooves criss-cross the cylindrical surface of nest 152 and provide channels for removing debris that could otherwise interfere with the rotational movement of cam components 20 and 22. These relief grooves could alternatively be located on outer cylindrical side portion 34, or on both. In addition, elongated rubber strips or wipers could be mounted to base 24 along the length of the clearance space located between the various cam components and nest 152 in order to help keep out debris such as metal shavings that can gull-up the cams.

Guide features 154 cooperate with the guide features 110 located on outer cam component 22 and, as previously explained, are designed to dictate a predetermine path for the outer cam component so that its movement during operation is controlled. Again, alternative guide features could be used in addition to or in lieu of the gib and keeper recesses shown here. Preferably, guide features 154 extend all the way to the end of base 24 so that when the retainer unit 26 is removed, the inner and/or outer cam components can be easily removed, thus facilitating easy and quick installation and replacement of cam components.

Retainer unit 26 fits on an end of axial shaft 42 assists in maintaining inner cam component 20 in proper axial alignment and in preventing the inner and outer cam components from extending beyond a predetermined extent. According to this embodiment, retainer unit 26 includes a hub assembly 180 and a brace 182. The hub assembly 180 is coaxially aligned with inner cam component 20 and includes a bushing 184 with optional guide channels 186, and a stop collar 188 securely attached to the end of axial shaft 42. The guide channels 186 can interact with a component that protrudes from the inner cam component into the axial bore 40, such as a bearing or pin (not shown here), and can dictate a predetermine path for the inner cam component 20 in much the same way as guide features 110, 154 dictated a predetermined path for the outer cam component 22. Although the guide channel is shown here as a straight, linear aligned groove, it is possible for the guide channel to extend on bushing 184 according to one of a number of different paths. One or more springs (not shown here) can be inserted within hub assembly 180 such that a spring force is exerted against inner cam component 20 in an axial direction S. Of course, other components known in the art, such as thrust washers, bearings, etc. can also be included within the hub assembly and used therein.

Brace 182 is designed to sturdily attach to base 24 so that it limits the axial motion of both the inner and outer cam components 20, 22. In the embodiment shown here, brace 182 is a piece of hardened steel shaped in the form of a strap with an aperture in the middle for receiving hub assembly 180. The brace can attach to base 24 with bolts 190 and/or any other fastening mechanisms known in the art. It should be appreciated that brace 182 should be strong enough to withstand axially directed forces imparted against it by one or both of the cam components. By acting as limit to axial movement of the cam components, retainer unit 26, and more specifically brace 182, work in conjunction with the adjacent cam assembly 150 to define a finite amount of total axial travel, as will now be discussed.

During operation, a force is exerted upon inner cam component 20 which causes it to move and, in turn, exert a force on outer cam component 22 thus driving the two cam components into an extended or forming position so that the work piece can be formed. The following description is provided in the context of adjacent cam assembly 150 having exerting a force against inner cam component 20, however as previously mentioned, one of any number of different sources could be used in place of cam assembly 150. Beginning with the retracted or unloading position shown in FIG. 6, adjacent cam assembly 150 exerts a force F against the inner cam component such that it pushes the inner cam component into the outer cam component. It should be noted that outer cam component 22 is spring biased in the direction S via the hub assembly (removed from FIGS. 6 and 7 for purposes of illustration), and that a separation exists between mating flange 62 and mating surface 120 thanks to a spring protruding from hole 122 (demonstrated by the misalignment of metal forming portions 36 and 106). As inner cam component 20 pushes outer cam component 22, helical contact surfaces 38 and 108 slide along one another and impart a relative helical motion to the two cam components, however, the outer cam component cannot travel in a helical path because of the axially aligned guide features 110, 154. Thus, outer cam component 22 travels in an axial path and inner cam component travels in a path having both axial and rotational components; a path that is generally dictated by the shapes of the helical contact surfaces.

Figure 7:
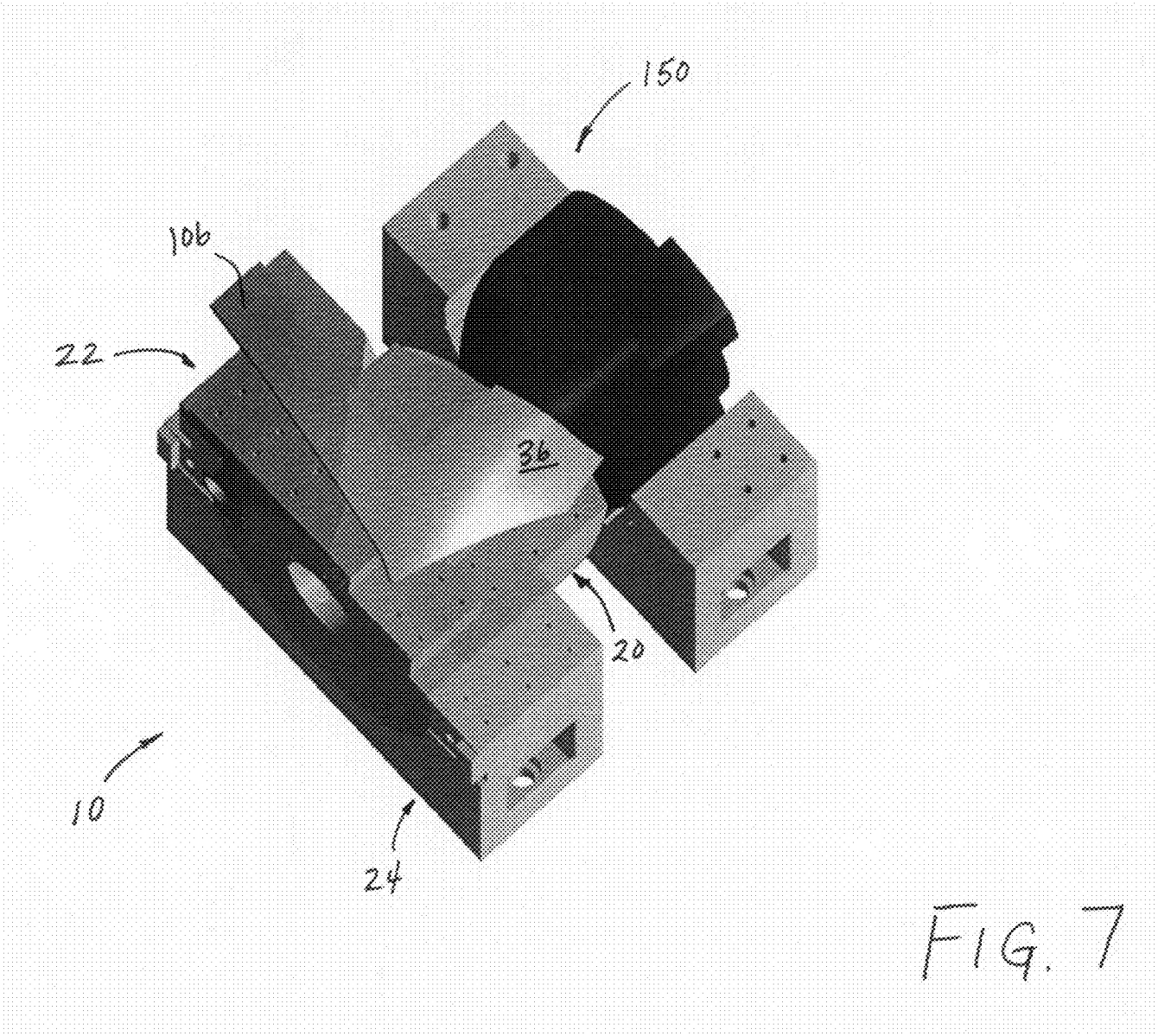

This generally conjoined movement continues until the point at which the pressure between the two cam components exceeds that of the spring force separating them, at which point the inner and outer cam components compress the spring and nest together. This nesting or mating could occur before they reach the axial end of their travel, as dictated by the retainer unit, or it could occur after the outer cam component contacts and is stopped by brace 182. It should be appreciated that by having a force exerting itself against the inner cam component (in this case cam assembly 150) and having outer cam component 22 pinned against brace 182, inner cam component 20 becomes squeezed so that it slides along contact surface 108 of the outer cam component and twists out into an extended or forming position. This squeezing or pinching affect is assisted by the fact that inner cam component is not restrained within a predetermined path, although such a path could certainly be used. Accordingly, the inner cam component is free to fill out the corner of the work piece according to the helical contact surface 38 so that the corner cam assembly 10 is in a fully extended position where metal forming portions 36 and 106 line up, as shown in FIG. 7.

Figure 6:
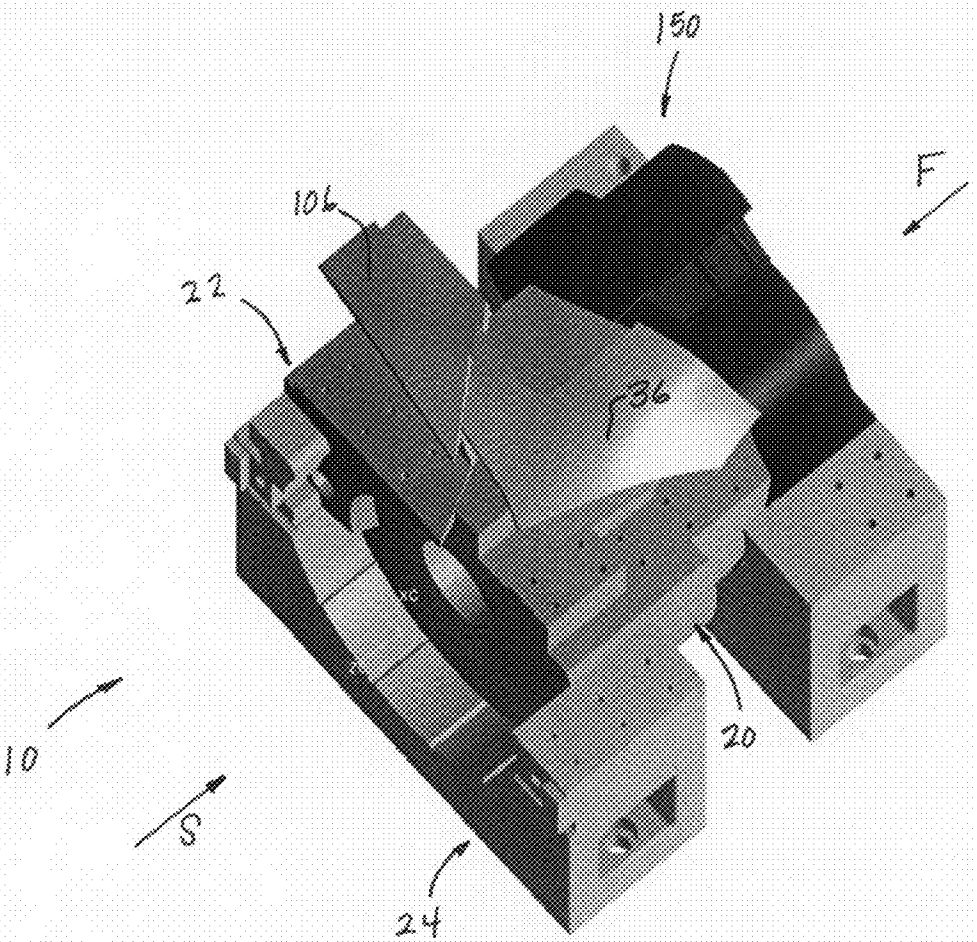
FIGS. 6-7 are isometric views of the corner cam assembly being used in conjunction with an adjacent cam assembly, where

To transition back to the retracted or unloading position shown in FIG. 6, adjacent cam assembly 150 backs off of inner cam component 20 and enables the various spring forces to return the inner and outer cam components to their retracted positions. This process involves a positive return action experienced by ramp sections 64 and 68.

Figure 8:
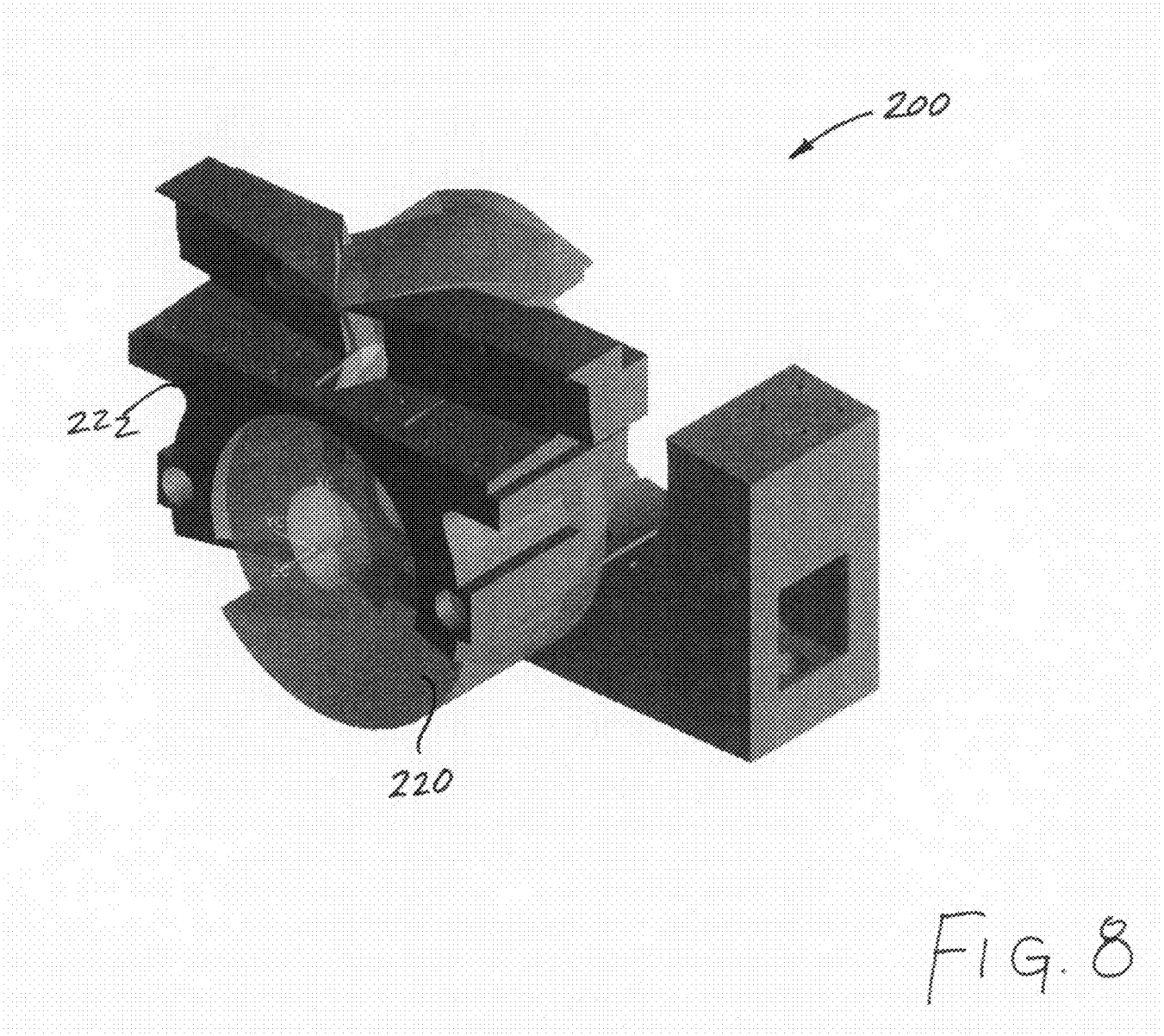
FIG. 8 shows another embodiment of a corner cam assembly, where the assembly includes an outer cam component extending approximately 180° around the periphery of the inner cam component.
Figure 1:
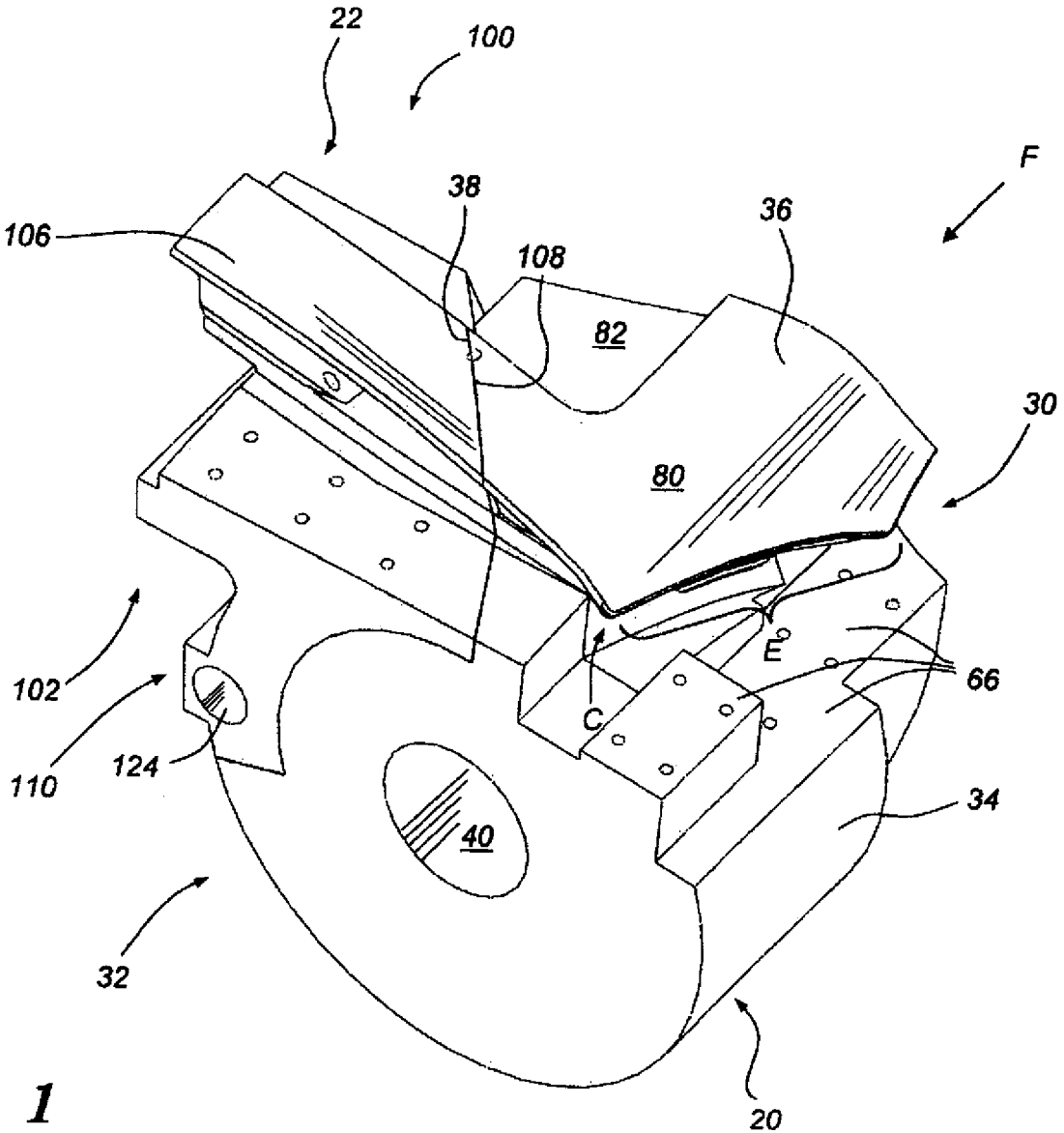
Figure 2:
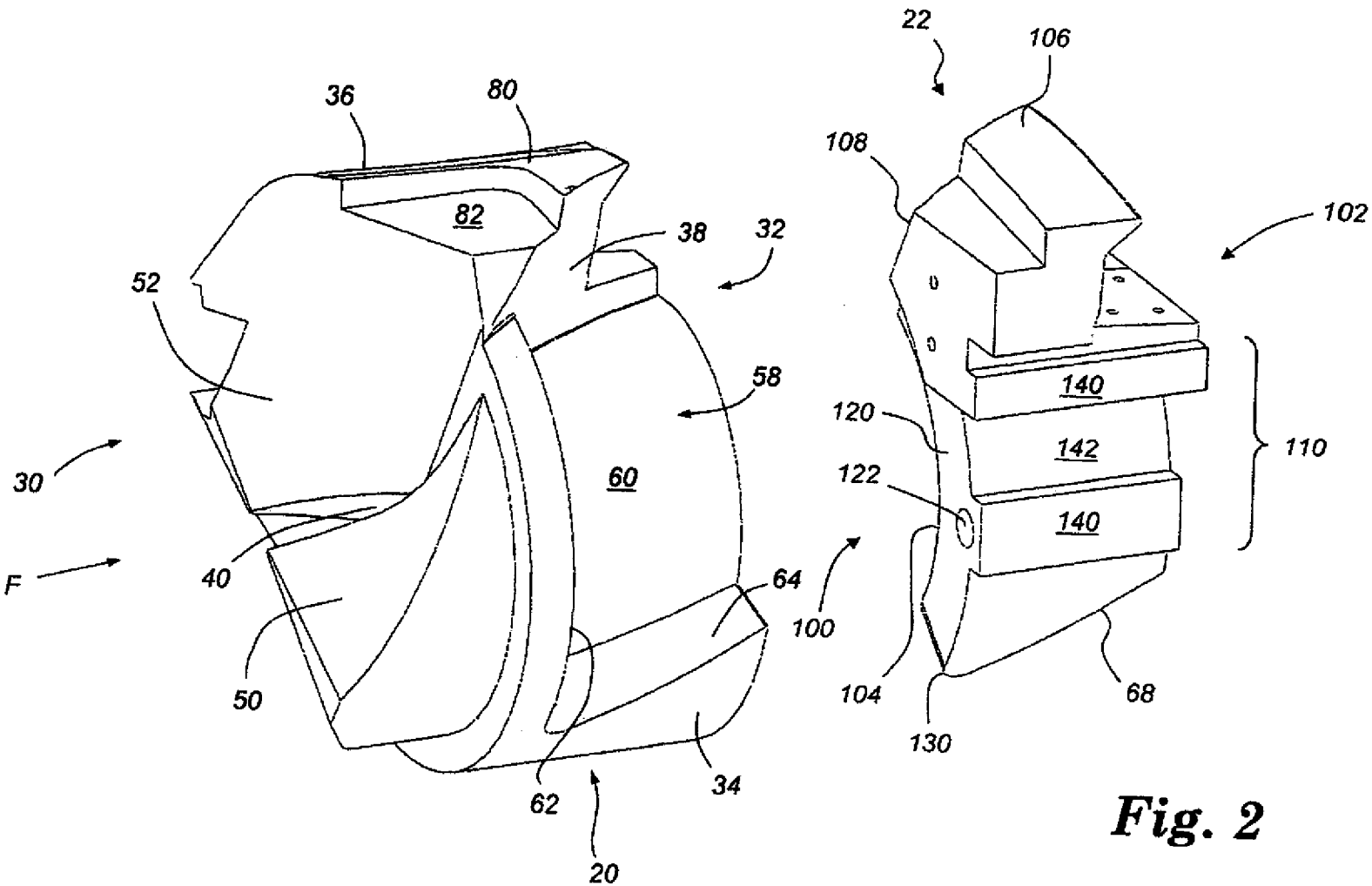
Figure 3:
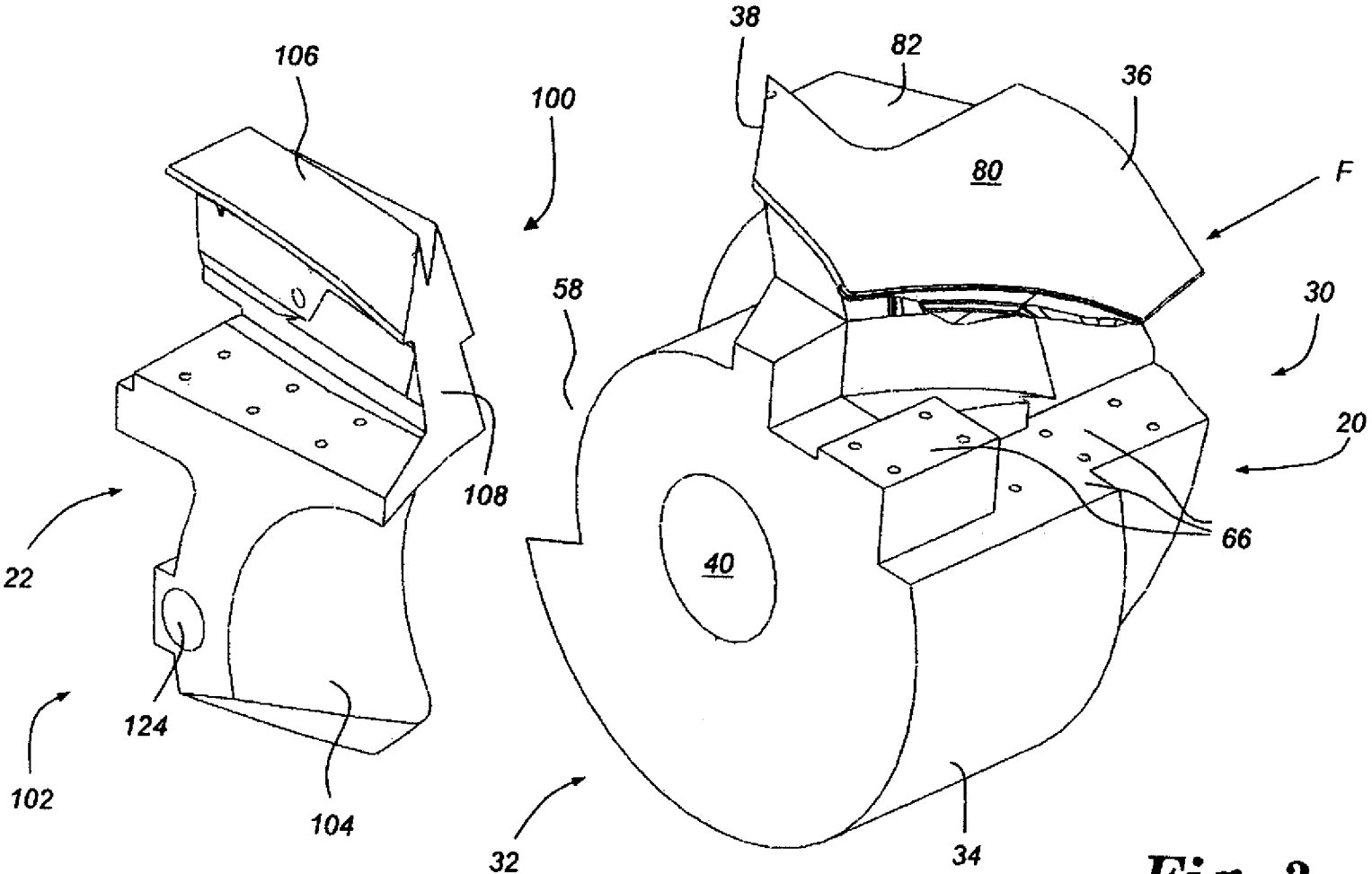
Figure 4:
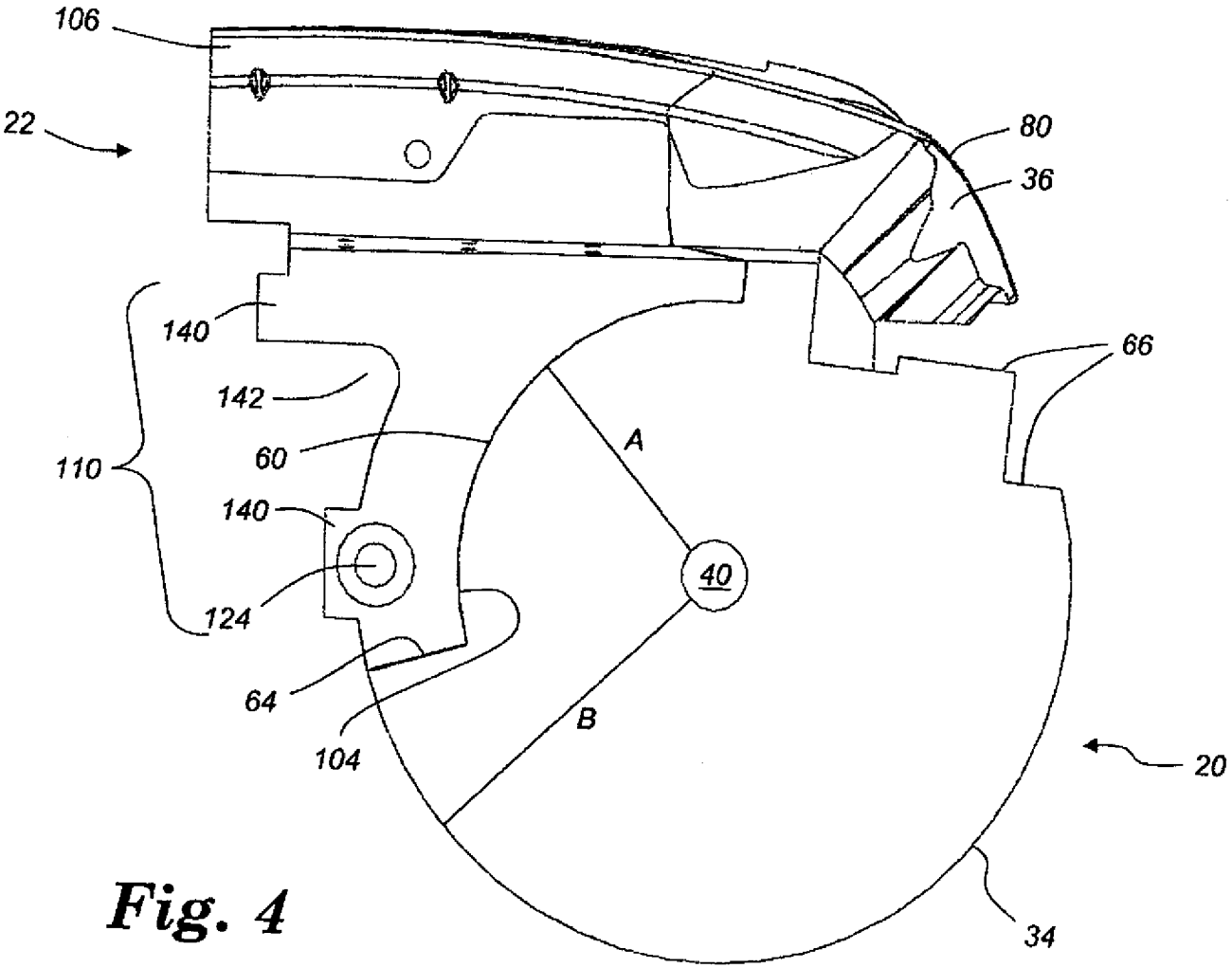
Figure 5:
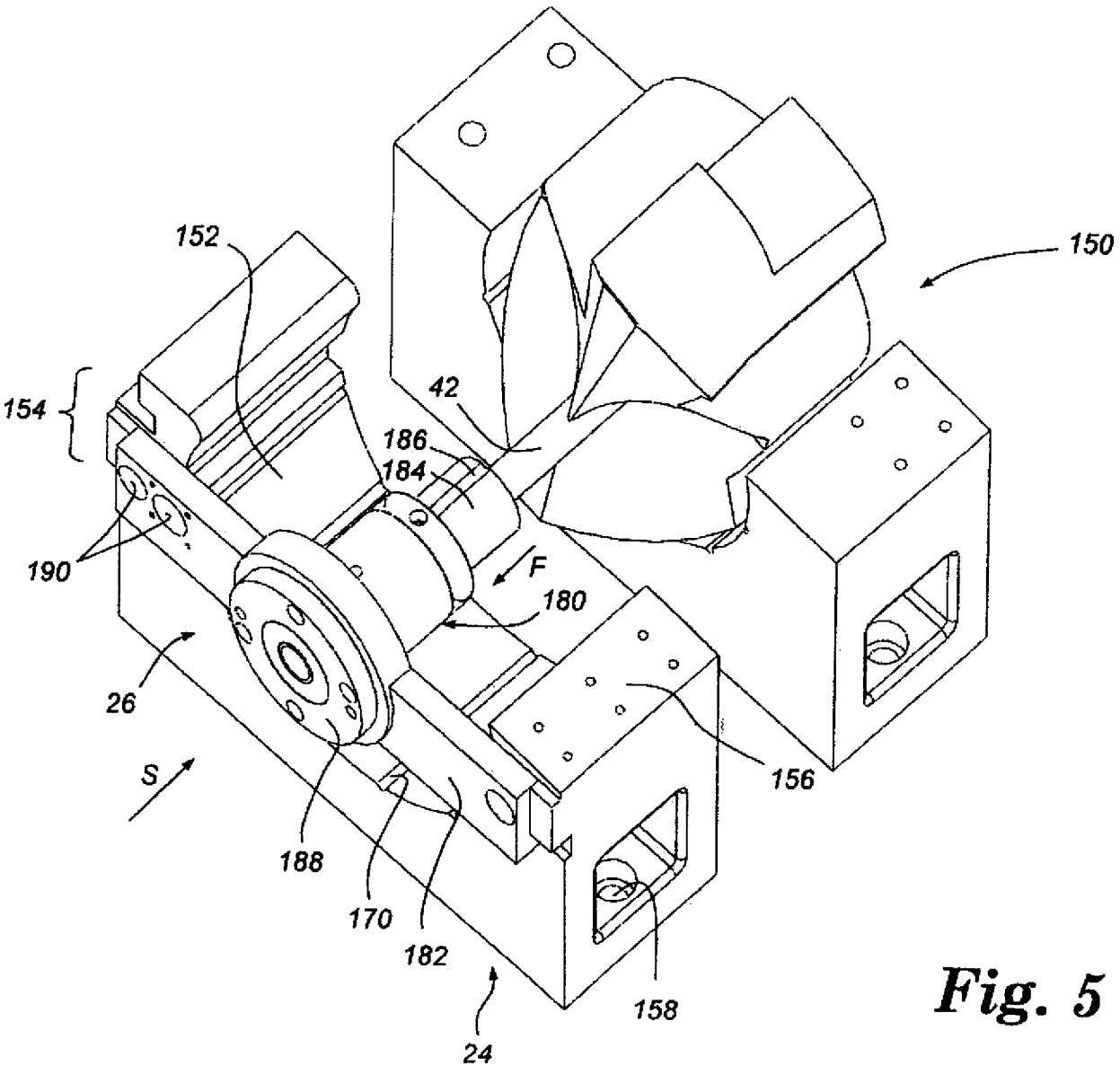
Figure 6:
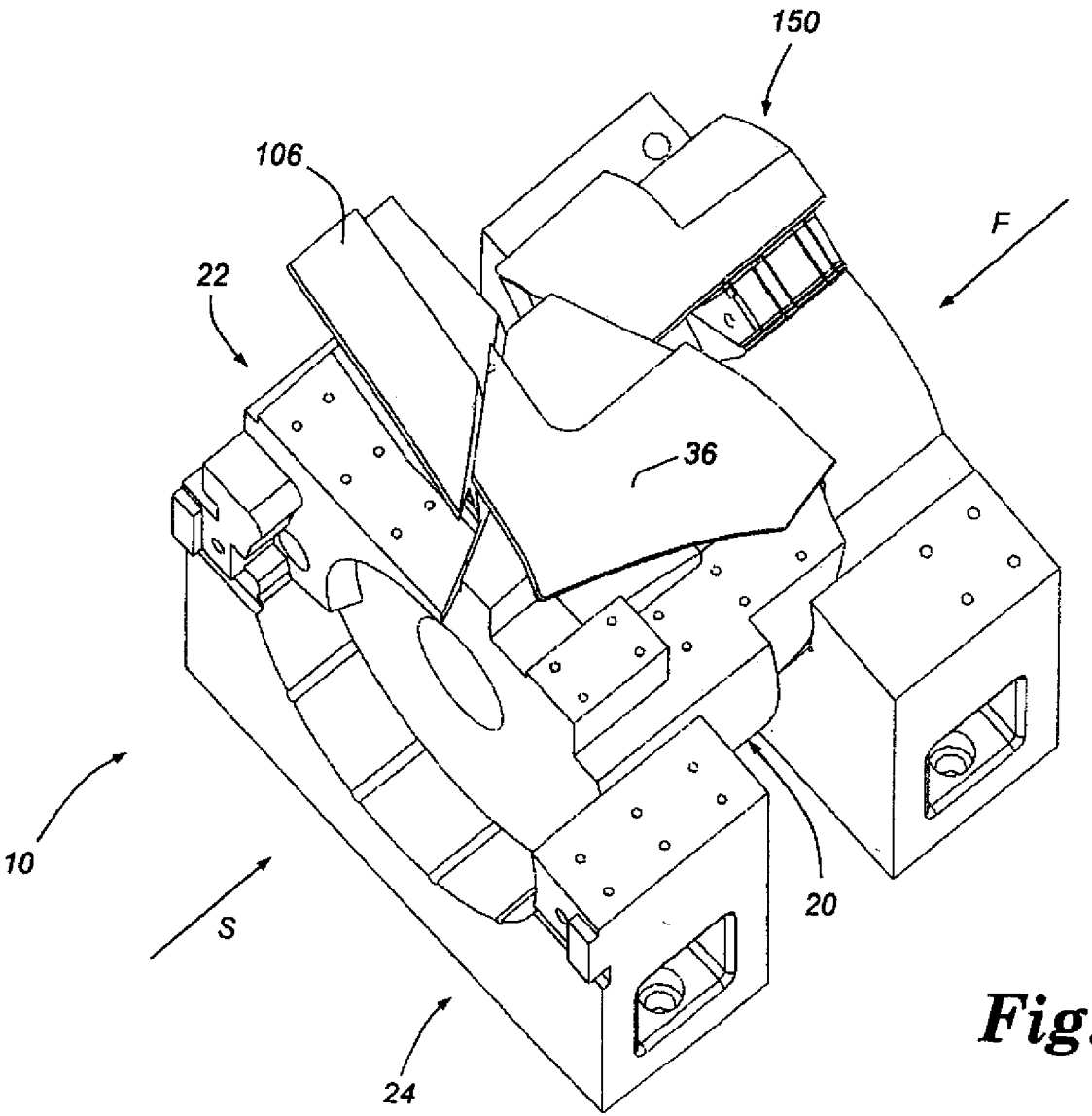
Figure 7:
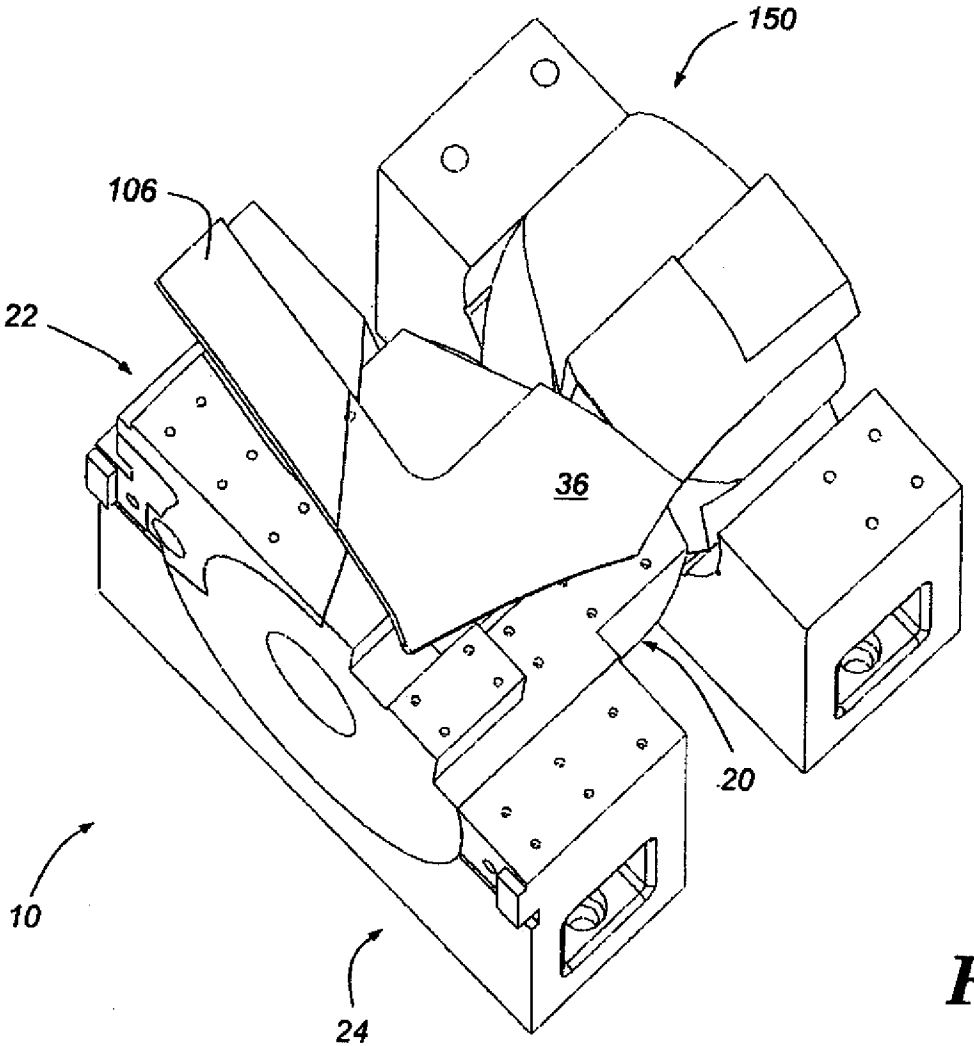
Figure 8:
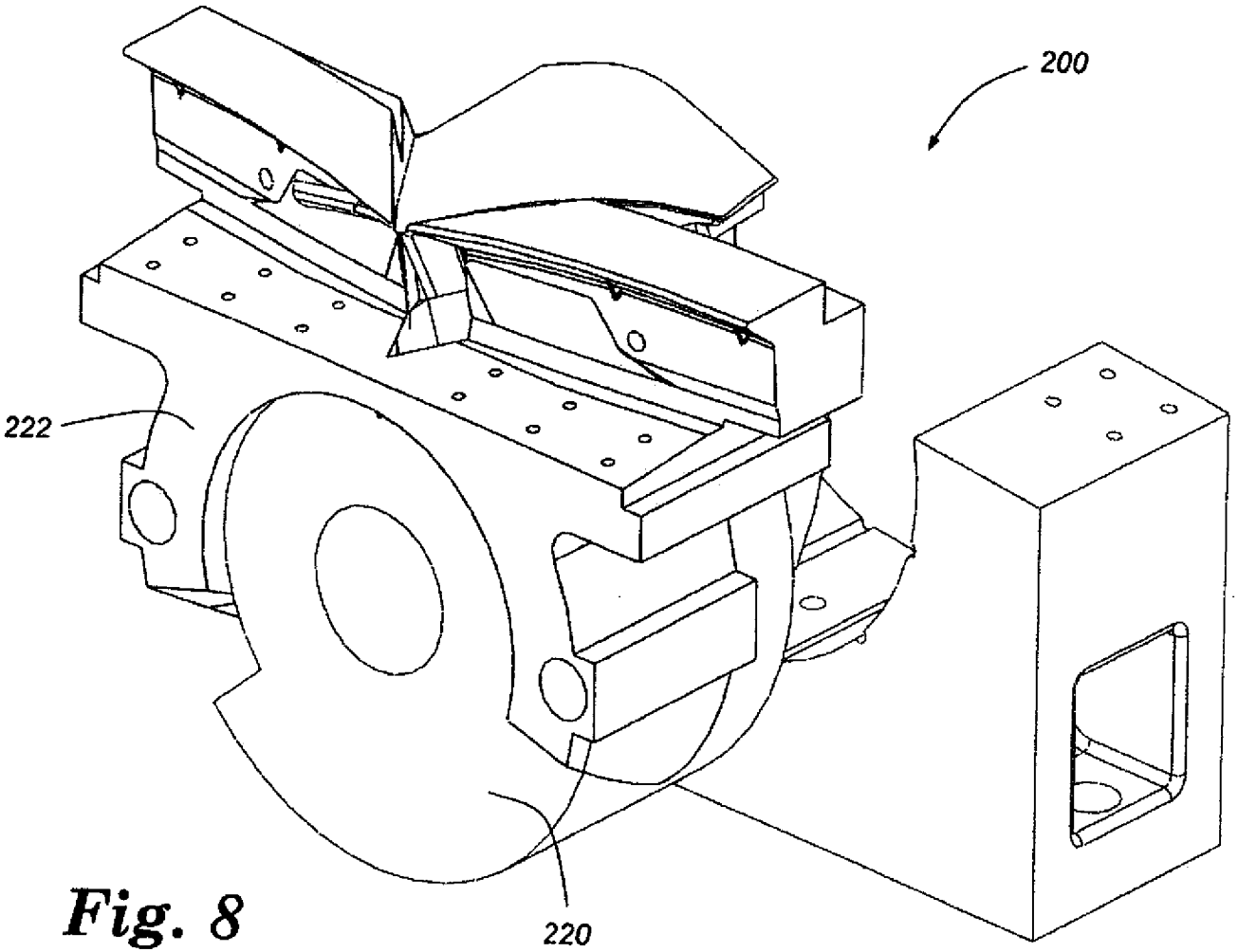

Turning now to FIG. 8, there is shown another embodiment of a corner cam assembly 200 that is largely the same as that previously described, with one difference being that an outer cam component 222 extends approximately 180° around an inner cam component 220. Like the previous embodiment, corner cam assembly 200 also uses contact surfaces between the inner and outer cam components to drive the cams into their desired positions. While the embodiment shown here extends for approximately 180° around the outer circumference of inner cam component 20 (see FIG. 4), it is possible for an outer cam component to extend for a greater or lesser angular extent than these exemplary embodiments. For instance, the outer cam component could extend for approximately 270° or even 360°, for example, around the outer periphery of the inner cam component. Additionally, it is foreseen that multiple outer cam components could be mounted around the periphery of the inner cam assembly. In such an embodiment, each of the outer cam components could be performing a different task and forming a different work piece feature.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "like," and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

I claim:

1. A cam assembly for use in forming a work piece, comprising:

an inner cam component being generally cylindrical and having a first contact surface, a first metal forming portion, and an axial bore that extends along a central axis of the inner cam component;

an outer cam component being generally located radially outward of the inner cam component and having a second contact surface and a second metal forming portion; and an axial shaft extending in the axial bore of the inner cam component and along the central axis of the inner cam component, wherein application of a force on the inner cam component causes a relative movement between the first and second contact surfaces such that the first and second metal forming portions act as a unitary metal forming portion for forming the work piece.

2. The cam assembly of claim 1, wherein at least one of the first and second contact surfaces extends in a generally radially orientation, with respect to the axial shaft.

3. The cam assembly of claim 1, wherein at least one of the first and second contact surfaces includes a helical surface for providing smooth relative movement between the inner and outer cam components.

4. The cam assembly of claim 1, wherein at least one of the first and second metal forming portions includes a replaceable work steel that can be removed from the cam component to which it is attached.

5. The cam assembly of claim 1, wherein the inner cam component further includes an axial end with a helical surface for contacting a complementary helical surface of an adjacent cam assembly, wherein application of a force against the inner cam component axial end causes relative movement between the inner and outer cam components.

6. The cam assembly of claim 1, wherein the inner cam component further includes a cylindrical side portion with a recessed section for receiving the outer cam component, the recessed section is at least partially defined by a ramp section and a mating flange.

7. The cam assembly of claim 1, wherein the inner cam component further includes a cylindrical side portion with an exterior slide surface defined by a constant radius A and an outer cylindrical surface defined by a constant radius B, wherein constant radius A is smaller than constant radius B.

8. The cam assembly of claim 1, wherein the outer cam component further includes an arcuate-like mating surface for contacting a complementary mating flange of the inner cam component.

9. The cam assembly of claim 1, wherein the outer cam component further includes guide features for interacting with cooperating features located on a base, wherein the guide features generally dictate a predetermined path for the outer cam component to follow during certain periods of operation.

10. The cam assembly of claim 9, wherein the guide features include at least one of a gib and a keeper channel and are aligned in an axial direction that is generally parallel to the central axis of the inner cam component.

11. The cam assembly of claim 1, further comprising a base having a nest for movably receiving the inner cam component and a retainer unit for limiting the axial extent of movement of at least one of the inner and outer cam components.

12. The cam assembly of claim 11, wherein the retainer unit is attached to the axial shaft and includes a hub assembly having at least one guide channel, the at least one guide channel dictating a predetermined path for the inner cam component.

13. The cam assembly of claim 1, wherein the outer cam component extends around approximately 90° of the periphery of the inner cam component.

14. The cam assembly of claim 1, wherein the outer cam component extends around approximately 180° of the periphery of the inner cam component.

15. The cam assembly of claim 1, wherein the cam assembly further comprises a plurality of outer cam components located around the periphery of the inner cam component.

16. The cam assembly of claim 1, wherein the first metal forming portion is designed to fill and form a corner of a work piece.

17. A cam assembly for use in forming a work piece, comprising:

an inner cam component having a first axial end, a second axial end, a central axis, and a side portion extending between the first and second axial ends over at least a portion of the inner cam component, the side portion is radially spaced from the central axis and includes a recessed section formed therein;

an outer cam component having a first axial end and a second axial end, the outer cam component is shaped to fit within the recessed section of the inner cam component such that the outer cam component is radially spaced from the central axis of the inner cam component; and a base receiving the inner cam component, and during a forming operation at least one of the inner or outer cam components travels in a path that includes both an axial component and a rotational component.

* * * * *

UNITED STATES PATENT AND TRADEMARK OFFICE

CERTIFICATE OF CORRECTION

PATENT NO. : 8,171,821 B2
APPLICATION NO. : 11/710165
DATED : May 8, 2012
INVENTOR(S) : Jeffrey C. Krozek It is certified that error appears in the above-identified patent and that said Letters Patent is hereby corrected as shown below:

The title page showing the illustrative figure should be deleted to be replaced with the attached title page.

In the drawings, Sheets 1-8 are informal drawings. Figs 1-8 should be replaced with the corrected Figs. 1-8 as shown on the attached pages.

Signed and Sealed this
Twenty-third Day of April, 2013

Teresa Stanek Rea
*Acting Director of the United States Patent and Trademark Office*

(12) United States Patent
Krozek

(10) Patent No.: US 8,171,821 B2
(45) Date of Patent: May 8, 2012

(54) CORNER CAM ASSEMBLY

(75) Inventor: Jeffrey C. Krozek, Harrison Township, MI (US)

(73) Assignee: Helical Cam, LLC, Algonac, MI (US)

( * ) Notice: Subject to any disclaimer, the term of this patent is extended or adjusted under 35 U.S.C. 154(b) by 1430 days.

(21) Appl. No.: 11/710,165

(22) Filed: Feb. 22, 2007

(65) Prior Publication Data

US 2008/0078344 A1 Apr. 3, 2008

Related U.S. Application Data

(60) Provisional application No. 60/847,887, filed on Sep. 28, 2006.

(51) Int. Cl.
*F16H 53/00* (2006.01)
*B21D 11/00* (2006.01)
*B21J 9/18* (2006.01)

(52) U.S. Cl. ..... 74/567; 72/313; 72/315; 72/452.9

(58) Field of Classification Search ..... 74/337.5, 74/53–61, 122–125, 567, 569; 72/313, 452.9, 72/452.4, 452.6, 452.7, 315; 269/902, 66, 269/138; 29/888.1

See application file for complete search history.

(56) References Cited

U.S. PATENT DOCUMENTS

| | | | | |
|---|---|---|---|---|
| 1,850,544 | A | | 3/1932 | Gray |
| 1,977,828 | A | | 10/1934 | Laib et al. |
| 2,176,895 | A | | 10/1939 | Engemann |
| 2,272,740 | A | | 2/1942 | Fader, Jr. |
| 2,633,112 | A | | 3/1953 | Engemann |
| 3,391,239 | A | | 7/1968 | Inouye |
| 3,955,241 | A | | 5/1976 | Little |
| 4,030,161 | A | | 6/1977 | Loikitz |
| 4,181,002 | A | | 1/1980 | Eckold et al. |
| 4,535,619 | A | | 8/1985 | Gargrave |
| 5,101,705 | A | | 4/1992 | Matsuoka |
| 5,163,662 | A | * | 11/1992 | Bernstein ..... 269/138 |
| 5,231,907 | A | | 8/1993 | Matsuoka |
| 5,347,838 | A | | 9/1994 | Matsuoka |
| 5,746,082 | A | | 5/1998 | Matsuoka |

(Continued)

FOREIGN PATENT DOCUMENTS

WO WO0179662 A1 10/2001

OTHER PUBLICATIONS

International Search Report for PCT/US07/08239, Mar. 27, 2008, 2 pgs.

*Primary Examiner* — Richard W Ridley
*Assistant Examiner* — Daniel Yabut
(74) *Attorney, Agent, or Firm* — Reising Ethington P.C.; Michael C. Adams

(57) ABSTRACT

A corner cam assembly for use with a forming die and including a generally cylindrical inner cam component, an outer cam component, a base, and a retainer unit. Contoured contact surfaces on the inner and outer cam components enable the components to slide past one another during transitions between retracted and extended positions. Some features of the corner cam assembly include helical contact surfaces, guide features that control movement of the cam components, removable work steels, standardized cam components, and being able to form negative and other tight angles, multiple corners and edges, to name but a few.

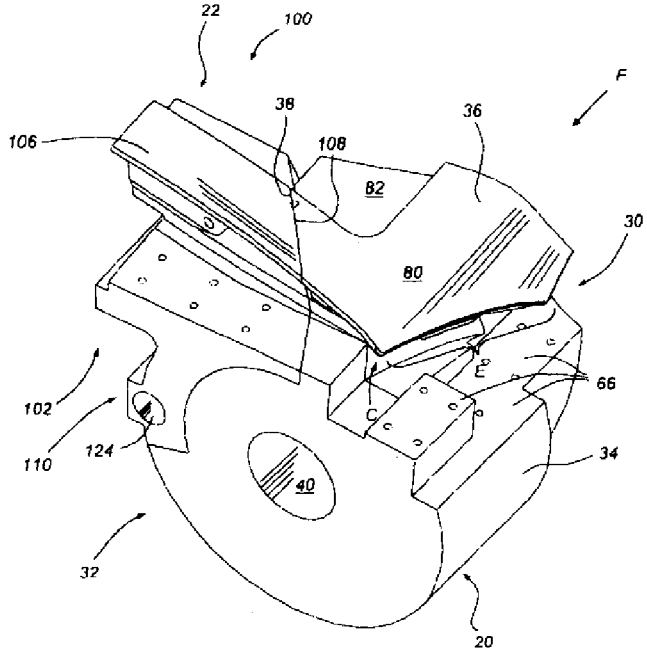

17 Claims, 8 Drawing Sheets